US006807778B2

(12) United States Patent
Engebretson

(10) Patent No.: US 6,807,778 B2
(45) Date of Patent: Oct. 26, 2004

(54) FENESTRATION FRAME ASSEMBLIES, E.G. RETROFIT WINDOW FRAME ASSEMBLIES, AND METHODS OF INSTALLING SAME

(75) Inventor: David Engebretson, Gig Harbor, WA (US)

(73) Assignee: Comfort Design, Inc., Tacoma, WA (US)

( * ) Notice: Subject to any disclaimer, the term of this patent is extended or adjusted under 35 U.S.C. 154(b) by 0 days.

(21) Appl. No.: 10/339,694

(22) Filed: Jan. 8, 2003

(65) Prior Publication Data

US 2003/0226321 A1 Dec. 11, 2003

Related U.S. Application Data

(63) Continuation-in-part of application No. 10/194,955, filed on Jul. 11, 2002.

(60) Provisional application No. 60/387,105, filed on Jun. 7, 2002.

(51) Int. Cl.[7] ..... E06B 3/66

(52) U.S. Cl. ..... 52/204.59; 52/204.34; 52/208

(58) Field of Search ..... 52/204.54, 208

(56) References Cited

U.S. PATENT DOCUMENTS

| | | | |
|---|---|---|---|
| 2,912,078 | A | 11/1959 | Kiehl et al. |
| 3,077,011 | A | 2/1963 | Boucher |
| 3,416,271 | A | 12/1968 | Heeney |
| 3,768,220 | A | 10/1973 | Riegelman, Jr. |
| 3,875,706 | A | 4/1975 | Okawa |
| 3,908,730 | A | 9/1975 | Goss, Jr. et al. |
| 3,935,683 | A | 2/1976 | Derner et al. |
| 3,964,231 | A | 6/1976 | Budich et al. |
| 4,019,295 | A | 4/1977 | Derner et al. |
| 4,114,342 | A | 9/1978 | Okawa |

(List continued on next page.)

FOREIGN PATENT DOCUMENTS

| | | |
|---|---|---|
| JP | 52-035438 | 3/1977 |

*Primary Examiner*—Carl D. Friedman
*Assistant Examiner*—Steve Varner
(74) *Attorney, Agent, or Firm*—Perkins Coie LLP

(57) ABSTRACT

Assembling window frame assemblies often requires skilled labor at a construction site. Various aspects of the invention provide frame assemblies and methods of installing that may reduce the need of skilled carpenters on-site in some circumstances. In one particular example, the invention provides a window frame assembly that includes a cover, a main frame, and a glazing pane. The cover has a transverse member that includes a mating projection. The main frame has a window opening and a confronting periphery. The confronting periphery includes a peripheral recess and a guide, with the peripheral recess being sized to telescopically receive a portion of the cover mating projection. The guide may include an outwardly flared guide surface that is adapted to guide the leading edge of the mating projection into the recess. The presence of the guide can greatly facilitate assembly of the cover and the main frame in a window housing.

29 Claims, 5 Drawing Sheets

U.S. PATENT DOCUMENTS 4,130,976 A 12/1978 Kesseler et al.
4,250,673 A 2/1981 Hubbard
4,267,660 A 5/1981 Kielhorn
4,285,184 A 8/1981 Turner, Jr.
4,328,650 A 5/1982 Garbell
4,335,550 A 6/1982 Johnson
4,385,470 A 5/1983 Bryson et al.
4,422,280 A 12/1983 Mertin et al.
4,436,084 A 3/1984 Carlston et al.
4,453,346 A * 6/1984 Powell et al. ..... 49/404
4,473,446 A 9/1984 Locke et al.
4,558,536 A 12/1985 Dunsmoor
4,563,846 A 1/1986 Webb
4,608,800 A 9/1986 Fredette
4,649,681 A 3/1987 Eisele
4,763,446 A 8/1988 Kelly
4,807,395 A 2/1989 Kelly
4,829,729 A 5/1989 Derner et al.
4,993,204 A 2/1991 Kuritsky et al.
4,995,213 A 2/1991 Bezubic
5,115,610 A * 5/1992 Kessler ..... 52/204.591
5,131,194 A 7/1992 Anderson
5,157,881 A 10/1992 Tashman et al.
5,319,879 A 6/1994 Rozycki
5,390,454 A 2/1995 Coddens
5,392,574 A 2/1995 Sayers
5,412,922 A 5/1995 Vittori et al.
5,644,894 A 7/1997 Hudson
5,660,010 A 8/1997 Sayers
5,784,853 A 7/1998 Hood et al.
5,791,104 A 8/1998 Baier et al.
5,892,619 A 4/1999 Chubb et al.
6,115,989 A 9/2000 Boone et al.
6,141,925 A 11/2000 Halvorson, Jr. et al.
6,467,226 B2 * 10/2002 Dodson et al. ..... 52/220.1

* cited by examiner

FENESTRATION FRAME ASSEMBLIES, E.G. RETROFIT WINDOW FRAME ASSEMBLIES, AND METHODS OF INSTALLING SAME

CROSS-REFERENCE TO RELATED APPLICATION

This application claims the benefit of U.S. Provisional Application No. 60/387,105 filed Jun. 7, 2002 and entitled "REPLACEMENT WINDOW FRAME," and is a continuation-in-part of U.S. Application Ser. No. 10/194,955 filed Jul. 11, 2002 and entitled "RETROFIT WINDOW FRAME AND METHOD," the entirety of each of which is incorporated herein by reference.

TECHNICAL FIELD

The present invention generally relates to fenestration products, e.g., windows. In particular, aspects of the invention relate to prefabricated fenestration frame assemblies and methods of installing such assemblies in a fenestration.

BACKGROUND

Increasingly, prefabricated fenestration products, i.e., prefabricated doors and windows, are used both in new construction and in renovation of existing buildings. Prefabricated fenestration products typically are formed for walls having a fixed thickness. If the thickness of the wall falls outside of acceptable tolerances, installation of the window or door can be problematic. This problem occurs with some frequency in new construction due to variations in the thicknesses and planarity of studs, sheet rock, and other components of the wall. This problem becomes particularly acute when installing new fenestration products in older buildings, which typically have a much wider variance in wall thicknesses depending on a number of factors, including the age and geographical location of the building thicknesses depending on a number of factors, including the age and geographical location of the building.

Some manufacturers have attempted to address the variation in wall thicknesses in new construction, with varying degrees of success. Baier et al., U.S. Pat. No. 5,791,104, the entirety of which is incorporated herein by reference, suggests a jamb extension assembly for doors and windows. This assembly employs a multicomponent frame that can be assembled from multiple components by a manufacturer. The frame includes a jamb extender receiving slot and a jamb. The jamb includes an extender flange formed of a thin sheet of synthetic material that is adapted to be snapped along preformed score lines to adjust the length of the extender flange. Variations in wall thicknesses are accommodated by adjusting the extender flange to the appropriate length by breaking off a portion of the extender flange along the appropriate score line. Unfortunately, this requires that a visible inner portion of the window unit be formed of a relatively thin, breakable sheet material. If the window is not perfectly rectangular, the jamb extender flange may not precisely align with the receiving slot. Particularly with larger window sizes, it can be difficult to shove the extender flange into the slot. Attempts to force the extender flange into the slot can cause the flange to break along the preformed score lines, largely defeating the cosmetic purpose of the jamb extender.

Adjustable jamb designs such as the one proposed by Baier et al. can be even more problematic in retrofit installations in existing buildings. After the Second World War, old-style wooden window frames were largely phased out in new home construction in the United States in favor of prefabricated aluminum frames. FIG. 1 schematically illustrates the basic structural design of such an aluminum frame 1. This aluminum frame 1 includes an inner portion 2 designed to mount within a "rough" window housing 3 in the wall. The frame 1 also includes an outer portion 4, which typically has a width (e.g., about 19 millimeters) about the same as the width of the inner portion 2. The inner and outer portions 2 and 4, respectively, of the frame 1 are demarcated at a cross-sectional midpoint of the frame 1 by a nailing flange 5 that extends outwardly from the outside periphery of the frame 1 to secure the frame 1 to the window housing 3.

The prior art aluminum frames 1 were designed for installation into window housings 3 made up of 2×4 inch (50 mm×100 mm) studs 6, or like materials, covered externally by a sheathing, insulating, or subsiding layer 7 and, occasionally, a subsill, jamb and header 12*a*. To install the frame 1, the frame 1 was partially inserted into the window housing 3 so that the inner portion 2 overlapped the subsill, jamb and header 12*a* and partially overlapped the stud 6. To secure the frame 1 within the window housing 3, a nail 10 was then driven through the nailing flange 5 into the stud 6.

After installation of the aluminum frame 1 was thus completed, the outside of the window housing 3 was "finished" by securing a layer of siding material 11, such as shingles, to the outer surface of the subsiding layer 7, abutted against an undersurface of the outer portion 4 of the frame 1 to cover the nailing flange 5. The inside of the window housing 3 was finished by securing an inner lining 12*b*, such as sheet rock or paneling, over the stud 6 and optional subsill, jamb, and header 12*a* of the window housing 3. This inner lining 12*b* was abutted against the inside face of the window housing 3 to form a finished interior sill. Sheet rock 12*c* or the like was used to finish the interior.

Aluminum window frames continued to be widely used in new home construction in the United States throughout the 1970s, after which they began to be phased out in favor of more energy-efficient, durable, and aesthetically appealing double-paned, extruded plastic frames. Along with this new construction boom, a large replacement market for modern plastic frames has developed in recent years. Accordingly, millions of households across the United States and elsewhere have elected to replace existing aluminum frames with more durable, attractive, and energy-efficient plastic frames.

There are three common methods for retrofit installation of modern plastic window frames into finished window housings 3 originally designed for the prior art aluminum frames 1. The most common method is to simply remove the old frame 1 in its entirety and install the replacement frame in its place (e.g., with an inner portion of the replacement frame seated atop the subsiding layer 7 and a portion of the stud 6 abutting, but not overlapping the inner lining 12*b*) without modifying the finished housing. However, modern, double-paned plastic window frames are considerably wider (one standard width is about 80 mm) than the aluminum frames (variable, but approximately 38 mm). This increased width is necessary to accommodate the double glazing panels and insulating airspace between the panels. Therefore, when modern plastic frames are installed according to the above method, the frame protrudes outwardly far beyond the window housing, creating an awkward external appearance and causing a structurally undesirable weight distribution. Such installation methods, although widely practiced, are discouraged or prohibited by building codes and special utility grants.

A second method for retrofit installation of modern, double-paned window frames into finished window housings 3 includes removing the old aluminum frame 1 and mounting the new frame on top of the existing subsill, jamb, and header 12*a* of the window housing 3. Under this alternative method, the installer must trim back the lining 12*b* to accommodate a deeper inset and a more flush external appearance of the frame. If the frame 1 is mounted on top of the subsill, jamb, and header 12*a*, the installer must trim out the outer portion (i.e., the subsill, jamb, and header 12*a* and subsiding layer 7) of the window housing 3 with wood or other filler material to eliminate gaps between the periphery of the new frame and the inner lining 12*b* and subsiding layer 7. This trimming, which typically requires a skilled carpenter at the building site, is expensive and can account for a large portion of the total retrofit installation costs.

As a third method, some installers apparently are retrofitting modern vinyl frames on top of the existing aluminum main frame by first removing the existing sash and fixed lite, then positioning the new frame in the resulting opening. Extensive on-site trimming with wood is still required to cover the subsill, jamb, and header 12*b* because of the variable width of the existing aluminum main frames 1. Typically, the new vinyl frame is butt-jointed to a piece of wood custom ripped on-site to the current width to hide the existing frame 1. Additional trim pieces must be custom cut to cover gaps between the new butt-jointed liner and the existing liner, as well as for the outside of the new window. These activities are extremely labor-intensive and require skilled carpenters, adding significantly to the cost of window renovation.

Retrofitting window frames into stucco-finished window openings can be complicated by difficulties in removing the stucco siding layer covering the nailing flange of the original frame to allow the original frame to be removed. Unlike shingles and other siding materials, stucco must be chipped away from the nailing flange and cannot be replaced easily after removal of the old frame. Due to the high cost of repairing stucco, it is common practice to leave the original aluminum frame in place and to mount the replacement frame over the original frame. This requires removing any nailing flanges from the replacement frame and mounting the frame within the opening bounded by the original frame after its glazing panel and any cross-pieces have been torn out.

However, the increased width of the replacement frame requires a deep inset so that the replacement frame can extend inward well beyond the inner face of the existing aluminum frame. This mounting arrangement forms a gap between the inner portion of the replacement frame and the lining portion of the original window housing. In current practice, this gap is trimmed with wood or other material cut on-site to fill or mask the gap, resulting in a significant increase in total retrofit installation costs. An additional drawback to this method is that the replacement frame, seated within the aperture defined by the original frame, causes extensive loss of site and daylight by narrowing the glazing panel aperture height and width. To avoid an unsightly external appearance of the window, the frame also must be modified by a special flange extending peripherally from the outside of the frame to cover the outer face of the original aluminum frame.

DETAILED DESCRIPTION

A. Overview

Figure 1:
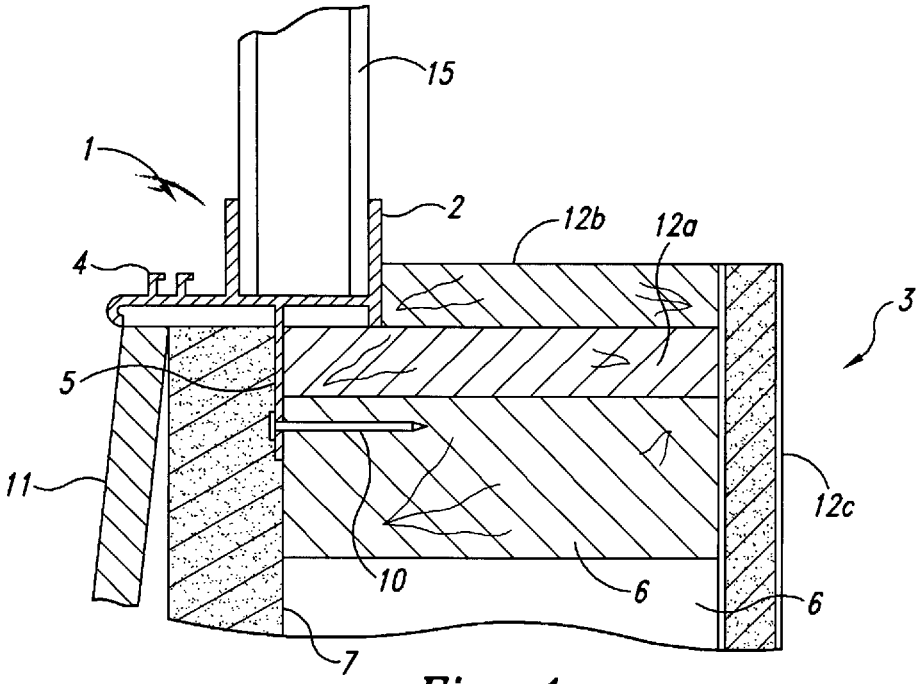
Fig. 1 (Prior Art)
FIG. 1 is a partial cross-sectional view schematically illustrating a prior art aluminum window frame installed in a window housing.

Various embodiments of the present invention provide fenestration frame assemblies, e.g., window frame assemblies, and methods of installing fenestration frame assemblies. Certain embodiments of the invention provide prefabricated window frame assemblies that can be installed by relatively unskilled laborers, yet yield a cosmetically superior product without extensive on-site customization. Other embodiments of the invention provide methods of installing window frame assemblies. In certain applications, the window frame assemblies may be particularly well suited for retrofit installations in existing structures without necessitating complete removal of an existing window frame.

In accordance with one embodiment, the invention provides a fenestration frame assembly. Such a fenestration frame assembly may comprise a door frame assembly or a window frame assembly, for example. The fenestration frame assembly includes a cover and a main frame. The cover includes a transverse member that has opposed first and second edges. A face is carried adjacent the first edge and a mating projection is included along the second edge. The mating projection may have a reduced thickness leading edge. The main frame may be adapted to support a closure member with respect to a main frame opening. (Such a closure member may comprise a glazing unit in the context of a window or a door in the context of a door frame, for example.) The main frame has a confronting periphery including a confronting edge and a guide spaced outwardly of the confronting edge to define a peripheral recess. The peripheral recess is sized to telescopically receive a width of the mating projection of the cover. The peripheral recess has an entrance between the confronting edge and a lip of the guide, with the lip of the guide including an outwardly tapering guide surface adapted to guide the leading edge of the mating projection into the recess.

Another embodiment of the invention provides a window frame assembly that includes a cover, a main frame having a window opening, and a glazing pane sealingly supported in the window opening. The cover includes a transverse member that has opposed first and second edges. A face is carried adjacent the first edge, and a transverse member includes a mating projection along the second edge. The main frame has a confronting periphery that includes a peripheral recess and a guide. The peripheral recess is sized to telescopically receive a portion of the mating projection of the cover. The guide may have an outwardly flared guide surface adapted to guide a leading edge of the mating projection into the recess.

A window frame assembly in accordance with another embodiment of the invention comprises a cover having a transverse member that has opposed first and second edges. A face is carried adjacent the first edge of the transverse member, and the transverse member includes a mating means along the second edge. This window frame assembly also includes a main frame having a window opening and a confronting periphery. The confronting periphery includes a peripheral recess and a guide means. The peripheral recess is sized to telescopically receive a portion of the mating means. The guide means may have an outwardly flared guide surface adapted to guide a leading edge of the mating means into the recess. A glazing pane may be sealingly supported in the window opening of the main frame.

One particular application of the invention provides a retrofitted window. This retrofitted window includes a building aperture having an inner surface and an existing window frame component installed in the building aperture proximate the inner surface. The existing window frame component has an inner edge circumscribing an existing frame aperture smaller than the building aperture. This retrofitted window also includes a cover that may comprise a transverse member and a face. The transverse member may have a first edge, a second edge spaced transversely from the first edge, an outer surface, and a mating projection along the second edge. The outer surface is juxtaposed with, but spaced from, the inner surface of the existing lining by a retrofit gap. The face is carried adjacent the first edge of the transverse member and extends peripherally outwardly from the transverse member a distance sufficient to span the retrofit gap. The retrofitted window may also include a support received in the retrofit gap that engages the inner surface of the building aperture and the outer surface of the transverse member. The retrofitted window further includes a main frame that is at least partially received in the existing frame aperture. The main frame circumscribes a window opening and includes an outer surface and a confronting periphery. At least a portion of the outer surface is supportively engaged by the inner edge of the existing window frame component. The confronting periphery includes a peripheral recess and a guide. A portion of the mating projection of the cover is telescopically received in the peripheral recess, and the guide has an outwardly flared guide surface adapted to guide the mating projection into the entrance. A glazing pane may be sealingly supported in the window opening.

Yet another embodiment of the invention provides a method of installing a window frame assembly. In accordance with one adaptation of this embodiment, a main frame is positioned with respect to a window housing. The main frame has a window opening and a confronting periphery. The confronting periphery includes a peripheral recess and a guide, with the guide having an outwardly flared guide surface. A cover is positioned with respect to the window housing and the main frame, with the cover including a mating projection along an edge thereof. A reduced thickness leading edge of the mating projection may be inserted into the peripheral recess, with the guide engaging at least a portion of the mating projection leading edge and guiding the mating projection into the recess.

For ease of understanding, the following discussion is subdivided into two areas of emphasis. The first section discusses fenestration frame assemblies in accordance with certain embodiments of the invention; the second section outlines methods in accordance with other embodiments of the invention.

B. Fenestration Frame Assemblies

As noted above, aspects of the invention provide fenestration frame assemblies, which generally include both door frame assemblies and window frame assemblies. The embodiments illustrated in the drawings and detailed below focus on window frame assemblies. It should be recognized, however, that the invention need not be so limited, and some embodiments of the invention can encompass door frame assemblies, as well.

Figure 2:
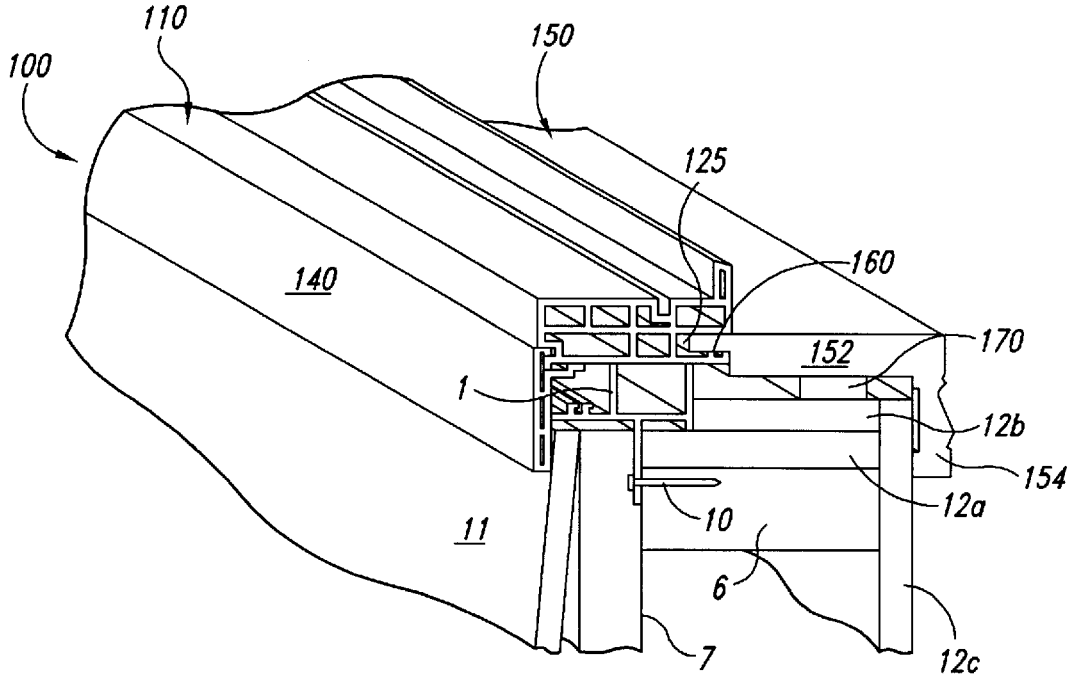
FIG. 2 is a perspective view schematically illustrating a portion of a fenestration frame assembly in accordance with one embodiment, mounted in a cutaway portion of an existing window housing.
Figure 3:
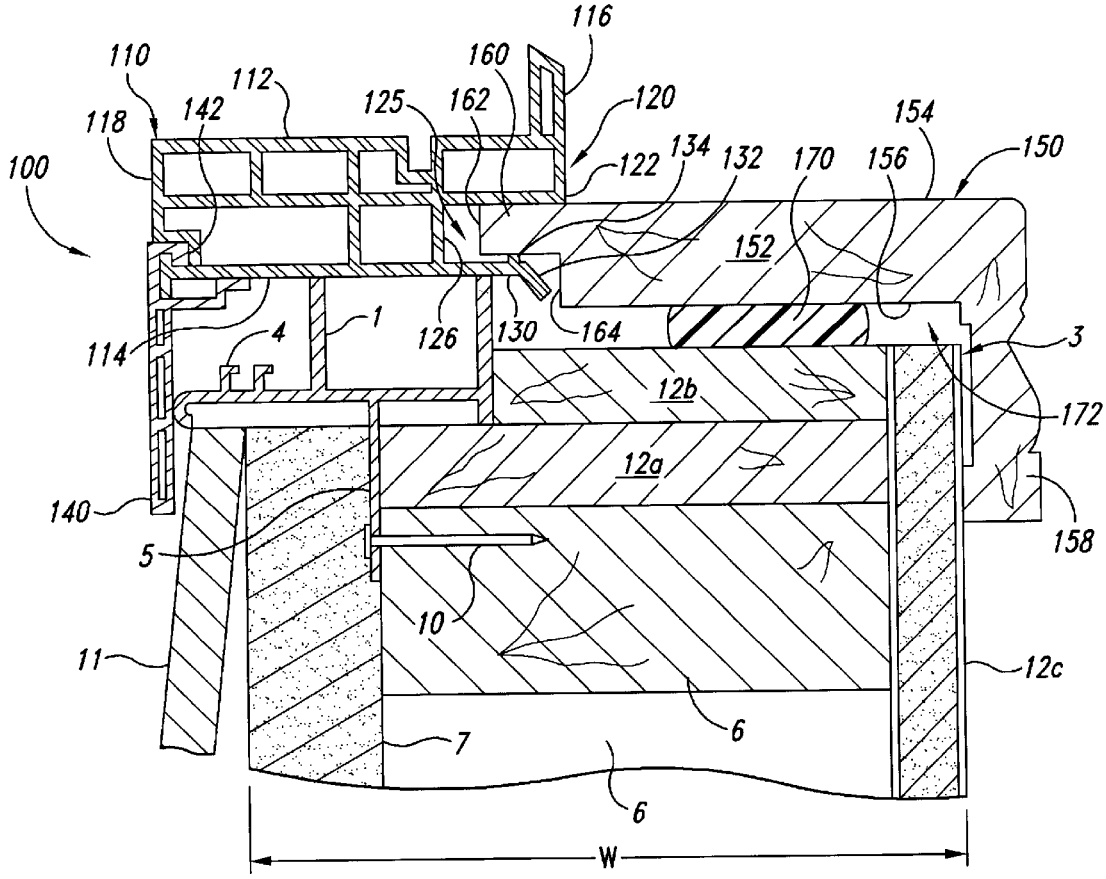
FIG. 3 is a schematic partial cross-section of the fenestration frame assembly shown in FIG. 2.

FIGS. 2 and 3 schematically illustrate a window frame assembly in accordance with one embodiment of the invention. This particular window frame assembly 100 is shown installed in a retrofit application, in which the window frame assembly 100 is installed in a finished window housing 3 similar to that shown in FIG. 1. Most of the structure illustrated in FIG. 1 remains in the installation shown in FIGS. 2 and 3 and like reference numbers are used in all three figures to indicate like structures. In FIGS. 2 and 3, the glazing (15 in FIG. 1) has been removed from the aluminum frame. This defines an opening within which a portion of the window frame assembly 100 can be received.

The window frame assembly 100 generally includes a main frame 110 and a cover 150. In the following discussion, the right side of FIG. 2 will be generally referred to as the "front" or "forward" portion of the structure and the left side of FIG. 2 may be referred to as the "back" or "rearward" portion of the structure. It should be recognized that these designations are solely for purposes of convenience and are not intended to specify any particular orientation with respect to the interior or exterior of the building, for example. In accordance with this adopted convention, the main frame 110 is disposed rearwardly in the window housing, and the cover 150 extends forwardly from the main frame 110.

The main frame 110 generally includes an inner periphery 112, an outer periphery 114, a front surface 116, and a back surface 118. Though only one leg of the window frame assembly 100 is shown in FIGS. 2 and 3, it is anticipated that the window frame assembly 100 will extend entirely about the interior surface of the window housing 3 defining a closed polygon, e.g., a rectangle, as is known in the art.

The main frame 110 also includes a confronting periphery 120 that is disposed immediately adjacent the cover 150. This confronting periphery 120 includes a recess 125 that is defined between a confronting edge 122 and a guide 130. The guide 130 may take a variety of forms. In the embodiment shown in FIGS. 2 and 3, the guide 130 comprises an elongated wall that is cantilevered from the back 126 of the recess 125. A forward lip of the guide 130 defines a guide surface 132. As explained below, the guide surface 132 may be adapted to guide the leading edge 162 of a mating projection 160 of the cover 150 into the recess 125 during the installation process. If so desired, the guide 130 may include one or more internal ribs 134. These internal ribs 134 may be adapted to engage an outer surface of the mating projection 160 to bias it upwardly toward the confronting edge 122 of the main frame 110, presenting a more cosmetically appealing appearance.

The main frame 110 may be formed of a variety of materials. In one embodiment, the main frame 110 is integrally formed from a polymeric material, such as an extrudable thermoplastic. In one particular embodiment, the main frame 110 includes a series of joined legs, each of which is integrally formed from an extruded vinyl.

In one embodiment, the guide 130 and/or its junction to the back of the recess 125 may be somewhat flexible. As explained below, this can permit the cantilevered wall that defines the guide 130 to deflect outwardly somewhat when joining the cover 150 to the main frame 110. The flexibility of the guide 130 may be defined, in part, by the materials selected for the main frame 110 (including the modulus of elasticity of the material), the length of the guide 130 that extends forwardly from the back 126 of the recess 125, and the thickness of the guide 130. In one useful embodiment, the guide 130 is formed of a resilient material, such as extruded vinyl, adapted to deflect during installation of the cover 150, yet allow the internal surface of the guide 130 (e.g., any internal rib 134 that may be employed) to resiliently urge upwardly against the mating projection 160 of the cover 150.

If so desired, a cowling 140 may extend peripherally outwardly from the back surface 118 of the main frame 110. In the illustrated embodiment, the cowling 140 is formed separately and is attached to the rest of the main frame 110 via a conventional accessory groove 142. If so desired, though, the cowling 140 may be integrally formed with the rest of the main frame 110.

The cover 150 generally includes a transverse body 152 that extends forwardly from the confronting periphery 120 of the main frame 110. The transverse body 152 may optionally include a casing 158 that extends peripherally outwardly from a forward edge of the transverse body 152. The width of the casing 158 may be varied as desired. In one embodiment, the casing 158 extends peripherally outwardly from the forward edge of the transverse body 152 farther than the greatest width of a retrofit gap 172 expected to be encountered in retrofit installations of the window frame assembly 100. The transverse body 152 has an inner surface 154 that faces toward the interior of the opening, and an outer surface 156 that is juxtaposed with an interior surface of the inner lining 12*b* of the window housing 3. If so desired, the outer surface 156 of the transverse body 152 may directly abut the inner surface of the inner lining 12*b*. In the illustrated embodiment, though, the outer surface 156 is spaced from the inner lining 12*b*, defining the retrofit gap 172 therebetween.

The cover 150 may be made from a variety of millwork products including solid wood (e.g., ponderosa pine), engineered wood fiber-thermoplastic composites, extruded thermoplastics without fillers, or any other material conventional in the field of window making. In the illustrated embodiment, the transverse body 152 and casing 158 are schematically shown as being integrally formed. In another embodiment, the casing 158 and transverse body 152 are formed separately and later joined to form the cover 150.

A mating projection 160 extends rearwardly from the rear edge of the transverse body 152. The mating projection 160 is sized to be slidably received in the recess 125 of the main frame 110. At least the leading edge 162 of the mating projection 160 may have a reduced thickness as compared to the thickness of the transverse body 152. In the illustrated embodiment, the entire mating projection 160 is thinner than the transverse body 152, defining a shoulder 164 at the junction between the mating projection 160 and the transverse body 152. This shoulder 164 may serve as a stop, abutting the leading edge of the guide 130 to limit movement of the cover 150 toward the main frame 110. In other embodiments, the mating projection 160 and transverse body 152 may have the same thickness.

When the cover 150 is installed with respect to the main frame 110, the leading edge 162 of the mating projection 160 is positioned within the recess 125. Because the mating projection 160 is slidably received in the recess 125, the cover 150 and main frame 110 are telescopically adjustable in a transverse direction to accommodate varying wall widths (W in FIG. 3). If the wall is thicker, the leading edge 162 may be positioned closer to the front entrance of the recess 125; if the wall width W is thinner, the mating projection 160 may extend further into the recess 125, with the leading edge 162 of the mating projection positioned closer to the back 126 of the recess 125.

The length of the mating projection 160 and the depth of the recess 125 can be varied. In one embodiment, the mating projection 160 has a length greater than the depth of the recess 125. In another embodiment, the recess 125 is deeper than the length of the mating projection 160. In still another embodiment, the length of the mating projection 160 is about equal to the depth of the recess 125. In one particular example, the depth of the recess 125 and the length of the mating projection 160 are both at least about 0.5 inches, e.g., about 0.5–2 inches. In another embodiment, this depth and length are both about 0.75–2 inches. Having a recess depth and a mating projection length between about 1 inch and about 2 inches should suffice for most applications. It may be advantageous to employ a deeper recess 125 and longer mating projection 160 in applications intended for use in retrofit installations than in new building construction because the variability in the wall width W tends to be greater in retrofit installations than in new construction.

As noted above, in the embodiments shown in FIGS. 2 and 3, the window frame assembly 100 is installed in an existing window housing 3 without removing the existing aluminum frame 1. In such an embodiment, the outer periphery 114 of the main frame 110 may rest on an inner periphery of the aluminum frame 1, at least along the bottom leg of the window housing 3. Due in part to variations in the thickness (or even omission) of the inner lining 12*b* in different installations, the distance between the outer surface 156 of the transverse body 152 and the inner surface of the inner lining 12*b* may vary from one installation to the next. When the cover 150 is joined to the main frame 110, there may be a retrofit gap 172 between the cover 150 and the inner lining 12*b*, as noted above.

In one embodiment, the retrofit gap 172 remains open and the cover 150 is simply spaced from the inner lining 12*b* around its periphery. In the illustrated embodiment, however, a shim or support 170 is disposed in the retrofit gap 172. The support 170 supportingly engages the outer surface 156 of the cover transverse body 152 and the inner surface of the inner lining 12*b*. The support 170 may structurally support the cover 150 between the main frame 110 and the casing 158, which may be nailed or otherwise attached to the sheet rock 12*c* of the wall. The support 170 need not extend around the entire periphery of the window frame assembly 100. In one particular embodiment, the support 170 is received in the retrofit gap 172 between the sill and the lower leg of the cover 150, but no shim is employed between the cover 150 and the vertically extending jambs or the upper header of the window housing 3. The support 170 may support the lower leg of the cover 150 with respect to the sill if the user places a heavy object on the cover 150 or leans or sits on the cover 150, for example.

The support 170 may be formed of any desirable material. In one embodiment, the support 170 comprises a relatively rigid material such as wood or a stiff thermoplastic material. In another embodiment, the support 170 comprises a more resilient material, such as a neoprene foam or the like. In addition to providing structural support to the cover 150, such a resilient support 170 may exert an inward bias on the cover 150, pushing the inner surface 154 of the cover 150 toward the confronting edge 122 of the main frame 110. This can provide a closer fit between the cover 150 and the main frame 110, enhancing the cosmetic appearance of the window frame assembly 100. The support 170 may comprise a single elongate block or length. In another embodiment, a series of separate supports 170 are spaced along the inner surface of the window housing 3 to engage spaced-apart locations on the outer surface 156 of the transverse body 152.

Figure 4:
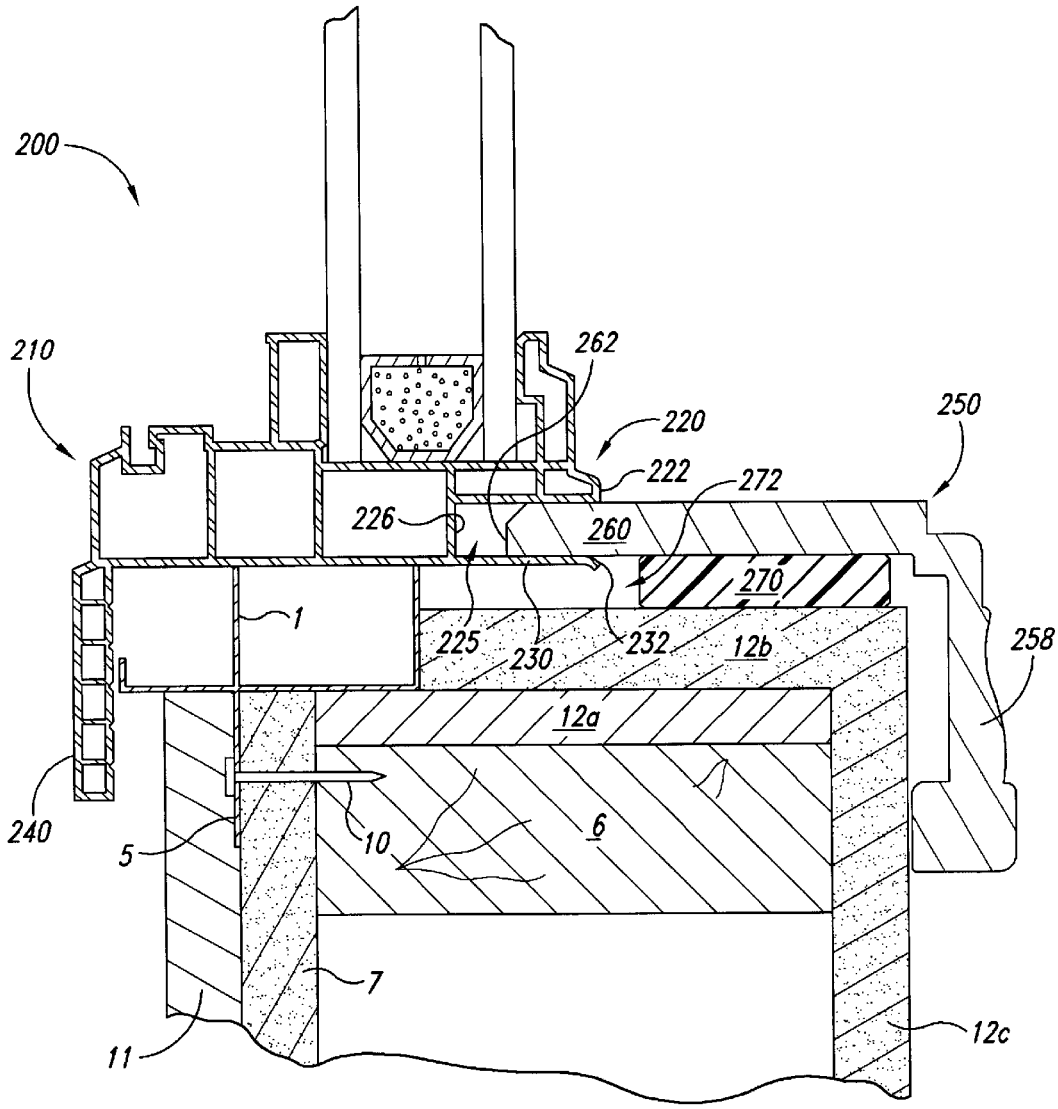
FIG. 4 is a schematic partial cross-sectional view of a window frame assembly in accordance with another embodiment of the invention.
Figure 5:
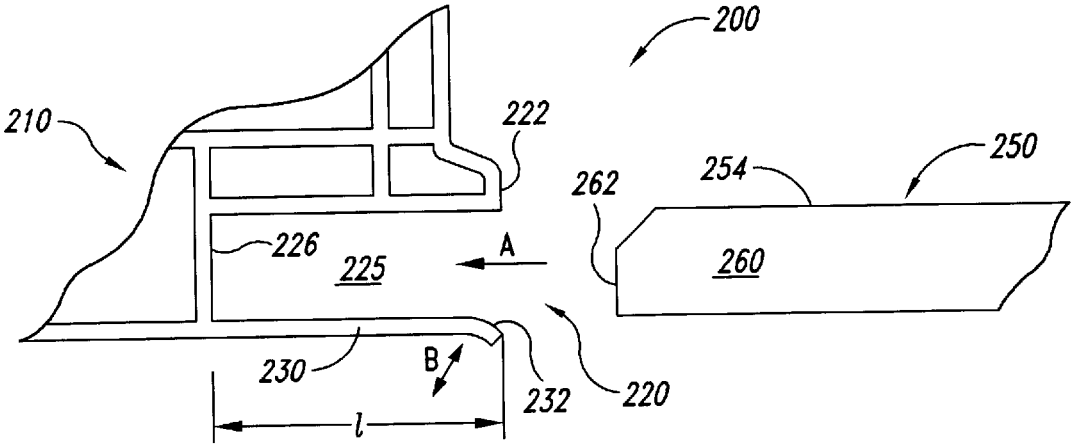
FIG. 5 is a schematic isolation view of a portion of the window frame assembly of FIG. 4.

FIGS. 4–6 schematically illustrate aspects a window frame assembly 200 in accordance with an alternative embodiment. The window frame assembly 200 includes a main frame 210 and a cover 250. The main frame 210 has a confronting periphery 220 including a recess 225 defined between a confronting edge 222 and a guide 230. The guide 230 comprises a cantilevered wall extending forwardly from the back 226 of the recess 225. A forward lip of the guide 230 is flared outwardly to define an outwardly curved guide surface 232. As in the prior embodiment, the guide 230 may be formed of a somewhat flexible material that permits the cantilevered guide 230 to deflect and move the guide surface 232 outwardly away from the confronting edge 222. Although the guide 230 shown in FIG. 4 does not include an internal rib (134 in FIG. 3), such an internal rib could be included on the guide 230.

The main frame 210 also includes a cowling 240. Unlike the previous embodiment in which the cowling 140 was formed separately and attached to the rest of the main frame 110 via an accessory groove 142, the cowling 240 in FIG. 4 is integrally formed with the other elements of the main frame 210, e.g., by being part of the same extruded body.

The cover 250 of the window frame assembly 200 of FIG. 4 includes a mating projection 260 extending rearwardly from a junction with the casing 258. In this embodiment, the transverse body and the mating projection 260 of the cover 250 are all the same thickness and may be thought of as one continuous element, in contrast to the embodiment shown in FIGS. 2 and 3, in which the shoulder 164 is defined by a change in thickness where the mating projection 160 joins the transverse body 152.

The embodiment of FIG. 4 also includes a support 270 disposed between the mating projection 260 and the inner lining 12*b* of the wall. The support 270 may extend around the entire outer periphery of the mating projection 260, along just a lower leg of the mating projection 260 to support the bottom of the cover 250 with respect to the subsill 12*a*, or along any other suitable segment of the outer periphery of the mating projection 260.

FIG. 5 is a schematic isolation view of the confronting periphery 220 of the main frame 210 and the mating projection 260 of the cover 250 shown in FIG. 4. In FIG. 5, the cover 250 and the main frame 210 are still separate from one another, i.e., they have not been assembled within the window housing 3 to define the completed window frame assembly 200 shown in FIG. 4. To assemble the window frame assembly 200, a leading edge 262 of the cover 250 may be inserted into the recess 225 in the main frame 210, as suggested by the arrow A. The leading edge 262 may be advanced within the recess 225 toward the back 226, telescopically adjusting the width of the window frame assembly 200 to accommodate different wall widths.

The cover 250 and recess 225 shown in FIGS. 4 and 5 include features that can facilitate assembly of the window frame assembly 200 in place at a construction site. Ideally, the window housing 3, the main frame 210, and the cover 250 would all be precisely formed with minimal tolerances to ensure an easy sliding entry of the leading edge 262 of the cover 250 into the recess 225. In reality, the precise alignment of the leading edge 262 with the recess 225 may be adversely impacted by a window housing 3 that is not perfectly true or rectangular, changes in dimensions of the main frame 210 and/or the cover 250 due to changes in temperature or humidity, or other factors.

The leading edge 262 shown in FIG. 5 is beveled to give it a reduced thickness compared to the rest of the mating projection 260. If a portion of the leading edge 262 deviates inwardly (i.e., upwardly in FIG. 5) from the illustrated position, the bevel on the leading edge 262 can abut the confronting edge 222 of the main frame 210. Further urging of the cover 250 toward the main frame 210 will cause the main frame confronting edge 222 to ride up the bevel, directing the leading edge 262 into the entrance of the recess 225.

If the mating projection 260 of the cover 250 is displaced outwardly (i.e., downwardly in FIG. 5) from the illustrated position, the leading edge 262 of the cover 250 will engage the curved, outwardly flared guide surface 232. As the cover 250 is urged toward the main frame 210, the leading edge will slide along the guide surface 232, which will help guide the leading edge 262 of the cover 250 into the recess 225.

As noted above, the guide 230 may be formed of a somewhat flexible material adapted to deflect in order to help introduce the leading edge 262 into the recess 225. As illustrated in FIG. 5, the guide 230 may comprise a wall that is cantilevered a length l forwardly from the back 226 of the recess 225. By appropriate selection of materials and this length l, the forward edge of the guide 230 may deflect outwardly away from the confronting edge 222 as suggested by the arrow B, and into the retrofit gap (272 in FIG. 4). This will, in turn, widen the entrance of the recess 225, further easing introduction of the leading edge 262 into the recess 225.

In the embodiment shown in FIG. 5, the mating projection 260 of the cover 250 is sized to have a relatively close fit in the recess 225. This can enhance the structural support of the back portion of the cover 250 by the main frame 210. This can also help ensure that an inner surface 254 of the cover 250 is positioned immediately proximate the confronting edge 222 of the main frame 210, enhancing the cosmetic appearance of the window frame assembly 200. Such a close fit makes it more difficult to insert the mating projection 260 into the recess 225, particularly with larger window sizes. Employing one or more of a beveled, reduced thickness leading edge 262, an outwardly flared guide surface 232, and a deflectable cantilevered guide 230 can significantly assist in assembling the window frame assembly in the field by relatively unskilled labor.

Figure 6A:
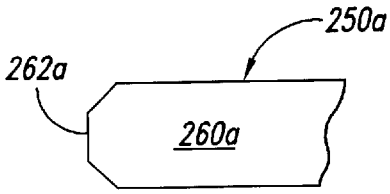
FIGS. 6A–D are schematic cross-sectional views of the leading edges of covers in accordance with different embodiments of the invention.

The leading edge 262 of the cover 250 in FIG. 5 has a single bevel adjacent the inner surface 254 of the cover 250. FIGS. 6A–D illustrate the mating projections 260*a–d*, respectively, of covers 250*a–d*, respectively, in accordance with four different embodiments. In the embodiment of FIG. 6A, the leading edge 262*a* is beveled adjacent the inner and outer surfaces of the mating projection 260*a*, but includes a blunt nose between the bevels. The lower bevel can cooperate with the guide surface (232 in FIG. 5) to further assist in guiding the cover 250*a* with respect to the main frame 210. The cover 250*b* of FIG. 6B includes a leading edge 262*b* that is generally arrow-shaped, with bevels extending inwardly from the inner and outer surfaces of the mating projection 260*b* to meet at a relatively sharp edge. In the embodiment of FIG. 6C, the leading edge 262*c* is curved, providing a smooth surface having a minimum thickness at the rearward extent of the leading edge 262*c*. The embodiment of FIG. 6D includes an arrow-shaped leading edge

Figure 6B:
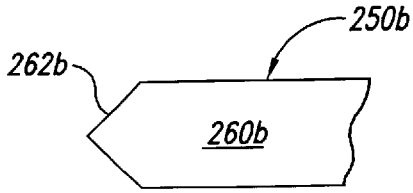
Figure 6C:
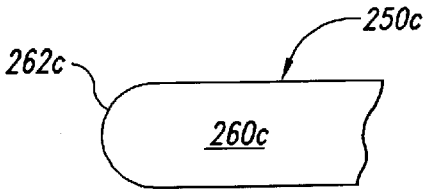
Figure 6D:
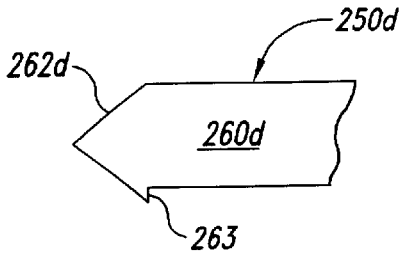

262*d* similar to the leading edge 262*b* of the cover 250*b* shown in FIG. 6B. The mating projection 260*d* of FIG. 6D, however, also includes a forwardly facing shoulder or barb 263. This shoulder 263 may be useful in conjunction with a guide 230 that includes an internal rib, which may be similar to the internal rib 134 shown in FIG. 3. By engaging the internal rib, the shoulder 263 of the leading edge 262*d* can help retain the cover 250*d* in the recess 225 of FIG. 5.

Figure 7:
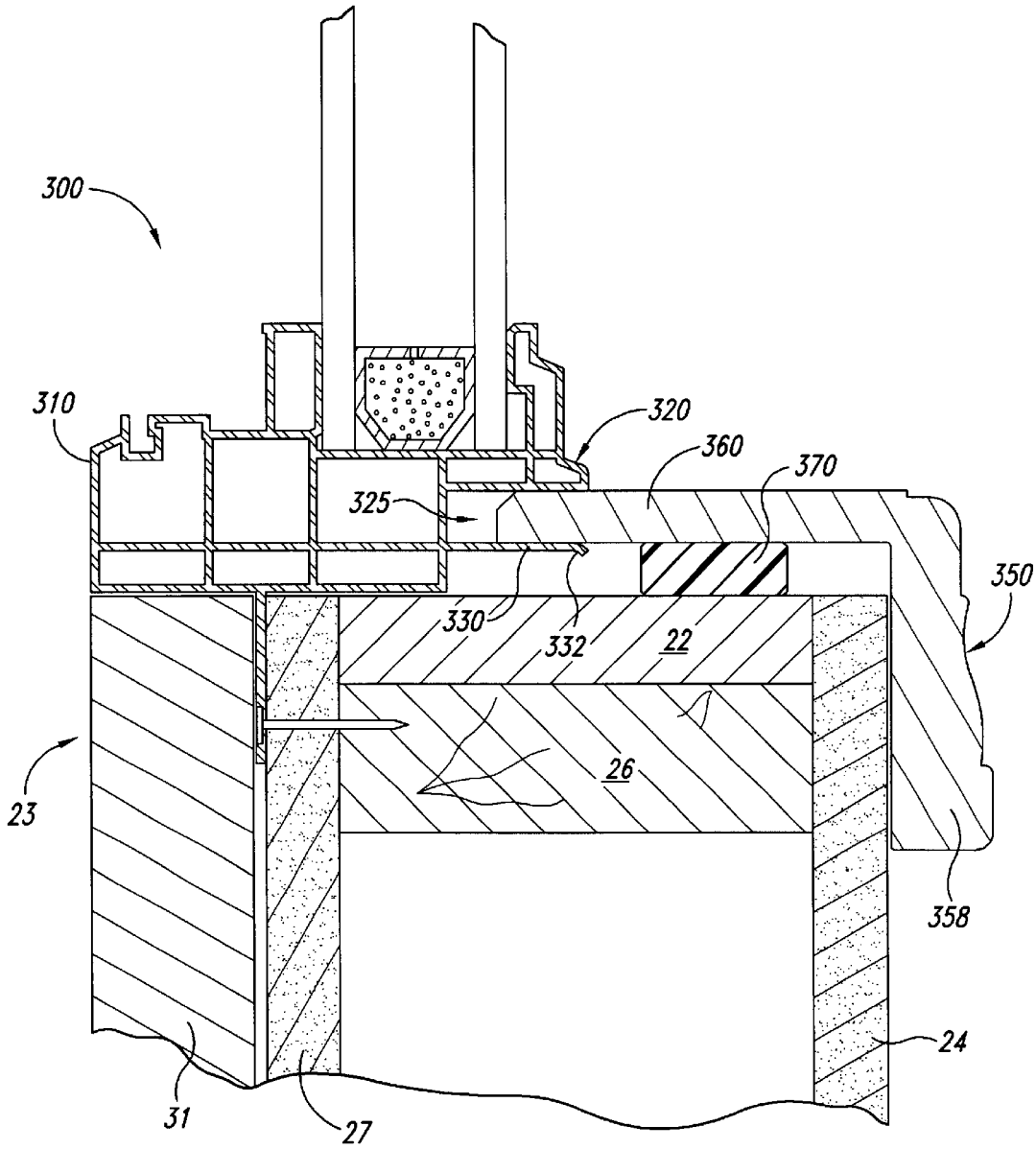
FIG. 7 is a schematic partial cross-sectional view, similar to FIG. 4, of a window frame assembly installed in a window housing in accordance with another embodiment of the invention.

FIG. 7 illustrates a window frame assembly 300 in accordance with another embodiment of the invention installed in a window housing 23 without an existing aluminum frame. The window housing 23 may comprise a fenestration in a newly constructed wall or may be achieved by removing the inner lining and existing frame (12*b* and 1, respectively, in FIG. 1) in a retrofit application. The window housing 23 may include an inner subsill, jamb, and header lining component 22 defining a polygonal (e.g., rectangular) inner mounting aperture. The framework of the window housing 23 may include a series of studs 26, subsiding 27, siding material 31, and an interior surface 24, e.g., sheet rock.

The window frame assembly 300 includes a main frame 310 and a cover 350. The main frame 310 includes a confronting periphery 320 having a recess 325 defined between a confronting edge 322 and a guide 330. The guide 330 may comprise a cantilevered wall including an angled or curved, outwardly flared guide surface 332. The cover 350 includes a mating projection 360 that extends rearwardly from a peripherally extending casing 358.

In the illustrated embodiment, a support 370 is disposed between the mating projection 360 and an interior surface of the window housing, e.g., an inner surface of the subsill, jamb, and header lining component 22. Much like the support 170 in FIGS. 2 and 3 and the support 270 of FIG. 4, this support 270 may help structurally support the mating projection 360 about some or all of the periphery of the window opening 23. Unlike a retrofit installation where the distance between the inner surface of the lining component 22 and the mating projection 360 of the cover 350 is not known, if the window frame assembly 300 is employed in new construction, this distance is likely more consistent. In such an application, it may be advantageous for some or all of the mating projection 360 to have a thickness equal to that of the mating projection 360 and the support 370 shown in FIG. 7, i.e., so an outer peripheral surface of the mating projection will extend into direct contact with the inner peripheral surface of the lining component 22.

Many of the functional aspects of the window frame assembly 300 of FIG. 7 are functionally similar to features of the window frame assembly 200 of FIGS. 4 and 5. One difference between these window frame assemblies 200 and 300 is that the main frame 310 of FIG. 7 includes a nailing flange 312 that extends peripherally outwardly from the rest of the body 310. This nailing flange 312 may be attached to a stud 26 or other portion of the window housing 23 via a plurality of nails 314 or the like.

C. Methods

As noted above, other embodiments of the invention provide methods of installing fenestration frame assemblies. In the following discussion, reference is made to the particular fenestration frame assemblies shown in the drawings discussed above. It should be understood, though, that the reference to these particular fenestration frame assemblies is solely for purposes of illustration and that the method outlined below is not limited to any of the fenestration frame assembly designs shown in the drawings or discussed in detail above.

1. New Window Installations

One embodiment of the invention provides a method of installing a window frame assembly. In one particular application of this method, a window frame assembly is installed in a window housing that is either a new window housing or is an existing window housing from which the existing frame (1 in FIG. 1) has been removed. Certain aspects of this embodiment are discussed in the context of FIG. 7, though any of a variety of other structures may be employed.

In accordance with this method, the main frame 310 of the window frame assembly 300 is positioned with respect to the window housing 23. In particular, the main frame 310 is positioned so that at least a portion of the main frame 310 extends into the aperture defined by the window housing 23. In the embodiment shown in FIG. 7, this may include allowing an outer surface of the main frame 310 to rest on an inner surface of the lining component 22 and attaching the nailing flange 312 of the main frame 310 to a portion of the window housing 23, e.g., via a plurality of nails 314.

The cover 350 is positioned with respect to the window housing 23 and the main frame 310. In the context of FIG. 7, this may comprise generally aligning the mating projection 360 of the cover 350 with the recess 325 in the main frame 310.

With the cover 350 so aligned, the cover 350 may be advanced rearwardly, i.e., to the left in FIG. 7. This will insert the reduced thickness leading edge 362 of the mating projection 360 into the peripheral recess 325 of the main frame 310. In most typical installations, the guide surface 332 of the guide 330 will engage the leading edge 362 of the cover 350 along at least a portion of the length of the leading edge 362. For example, if the cover 350 is slightly skewed with respect to the peripheral recess 325, portions of the mating projection 360 may be spaced inwardly from the guide 330, while other portions of the mating projection 360 may strike the guide 330. The engagement between the leading edge 362 of the cover 350 and the guide surface 332 of the guide 330 will help guide the mating projection 360 into the recess 325. As discussed above in connection with FIG. 5, for example, the guide 330 may comprise a cantilevered wall that is adapted to deflect outwardly away from the confronting edge 322 in response to the force of the leading edge 362 against the guide surface 332. This will make the entrance of the peripheral recess 325 wider, facilitating entry of the mating projection 360 into the recess 325.

The main frame 310 may telescopically receive the mating projection 360, reducing the distance between the cowling 340 of the main frame 310 and the casing 358 of the cover 350 until the cowling 340 and casing 358 engage opposite sides of the wall. The cover 350 may then be affixed within the window housing 23 with respect to the main frame 310, e.g., by attaching the cover 350 to the main frame 310 or attaching the casing 358 of the cover 350 to the wall.

2. Retrofit Window Installations

In other applications, embodiments of the invention provide methods for retrofit installation of a window frame assembly in an existing window housing without requiring removal of an existing window frame. As a preliminary step, the method may include preparing an existing window to receive the new window frame assembly. With an existing window, such as that shown in FIG. 1, this may entail removing the glazing 15 from the existing aluminum frame 1, defining an existing frame aperture that is circumscribed by the inner edge of the aluminum frame 1.

An appropriately sized main frame and cover may then be selected for installation in the existing frame aperture. In some applications, the main frame and cover may be custom manufactured to fit a specific frame aperture in a specific building. In the context of FIG. 4, for example, this may entail selecting a window frame assembly 200 that includes a main frame 210 having an outer periphery (excluding the cowling 240) sized to be received in the existing frame aperture. In one embodiment, the outer periphery of the main frame 210 is about the same size as the existing frame aperture so that the main frame 210 will substantially fill the existing frame aperture.

The main frame 210 may be positioned with respect to the existing frame aperture by introducing a front portion of the main frame 210 into the existing frame aperture. The existing aluminum frame 1 may help support the main frame 210 within the existing frame aperture. Although the existing frame 1 may engage the entire outer periphery of the main frame 210, this is not believed to be necessary. If the outer periphery of the main frame 210 is slightly smaller than the existing frame aperture, a lower leg of the main frame 210 may rest on the inner edge of the lower leg of the existing frame 1. In the particular embodiment shown in FIG. 4, this will allow the cantilevered guide 230 to extend above the inner surface of the inner lining 12*b*, leaving room for the front edge of the guide 230 to deflect outwardly from the confronting edge 222 of the main frame 210, as discussed above in connection with FIG. 5.

The cover 250 may then be positioned with respect to the main frame 210 and the window housing 3 as discussed above. The mating projection 260 of the cover 250 may then be advanced into the peripheral recess 225 until the casing 258 of the cover 250 engages the inner surface of the wall, i.e., the inner surface of the sheet rock 12*c* in FIG. 4. If the main frame 210 is not already in its intended position, it may also be advanced forwardly within the existing frame aperture until it is in its desired position, e.g., until the cowling 240 engages the back surface of the existing frame 1. The main frame 210 and the cover 250 may then be affixed in position with respect to one another and/or the wall, as described above.

In the embodiment shown in FIG. 4, the outer surface of the mating projection 260 is juxtaposed with, but spaced from, the inner surface of the inner lining 12*b*, defining a retrofit gap 272. In one embodiment, this retrofit gap 272 may be left open about the entire periphery of the cover 250. In another embodiment, a support 270 may be disposed in the retrofit gap 272 to supportingly engage the inner lining 12*b* and the cover 250, as noted previously. If such a support 270 is to be employed, the support 270 is advantageously positioned on the inner lining 12*b* before the cover 250 is inserted into the recess 225 of the main frame 210. It may be necessary to try several different supports 270 until the correct thickness is achieved. In one embodiment, this may comprise adding a series of layers or otherwise adjusting the thickness of the support 270, much like one may adjust the thickness of a shim in some other contexts.

If the support 270 is formed of a somewhat resilient material, such as a neoprene foam or the like, the support 270 may be positioned along some or all of the inner periphery of the inner lining 12*b*. Thereafter, the cover 250 may be introduced, with the mating projection 260 compressing the support 270 sufficiently to allow the leading edge 262 of the cover 250 to align with the entrance of the recess 225. Such a resilient support 270 may urge the mating projection 260 inwardly along some or all of the periphery of the cover 250. In such an application, the reduced thickness leading edge 262 of the cover 250 (which may include a bevel, as noted above), the guide surface 232, and/or deflection of the cantilevered guide 230 may facilitate entry of the slightly misaligned mating projection 260 into the recess 225.

Unless the context clearly requires otherwise, throughout the description and the claims, the words "comprise," "comprising," and the like are to be construed in an inclusive sense as opposed to an exclusive or exhaustive sense, that is to say, in a sense of "including, but not limited to." Words using the singular or plural number also include the plural or singular number, respectively. When the claims use the word "or" in reference to a list of two or more items, that word covers all of the following interpretations of the word: any of the items in the list, all of the items in the list, and any combination of the items in the list.

The above-detailed descriptions of embodiments of the invention are not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, whereas steps are presented in a given order, alternative embodiments may perform steps in a different order. The various embodiments described herein can be combined to provide further embodiments.

In general, the terms used in the following claims should not be construed to limit the invention to the specific embodiments disclosed in the specification, unless the above-detailed description explicitly defines such terms. While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. A fenestration frame assembly comprising:

a cover having a transverse member, which has opposed first and second edges, and a face carried adjacent the first edge, the transverse member including a mating projection along the second edge, the mating projection having a reduced thickness leading edge; and a main frame adapted to support a closure member with respect to a main frame opening, the main frame having a confronting periphery including a confronting edge and a guide spaced outwardly of the confronting edge to define a peripheral recess sized to telescopically receive a width of the mating projection of the cover, the peripheral recess having an entrance between the confronting edge and a lip of the guide, the lip of the guide including an outwardly tapering guide surface adapted to guide the leading edge of the mating projection into the recess.

2. The fenestration frame assembly of claim 1 wherein the guide comprises a wall cantilevered from a back of the recess.

3. The fenestration frame assembly of claim 1 wherein the guide comprises a cantilevered wall and the lip comprises an outwardly curved flare on a front portion of the wall.

4. The fenestration frame assembly of claim 1 wherein the guide comprises a cantilevered wall adapted to deflect to move the lip outwardly away from the confronting edge to receive the leading edge of the mating projection.

5. The fenestration frame assembly of claim 1 wherein the guide comprises a wall adapted to engage an outer surface of the mating projection and bias the mating projection toward the confronting edge.

6. The fenestration frame assembly of claim 1 wherein the peripheral recess includes at least one internal rib adapted to engage an outer surface of the mating projection.

7. The fenestration frame assembly of claim 1 wherein the peripheral recess has a depth of at least about 0.5 inches extending rearwardly from the entrance to a back of the recess.

8. The fenestration frame assembly of claim 1 wherein the peripheral recess has a depth of about 0.5–2 inches extending rearwardly from the entrance to a back of the recess.

9. The fenestration frame assembly of claim 1 wherein the peripheral recess has a depth of about 0.75–2 inches extending rearwardly from the entrance to a back of the recess.

10. The fenestration frame assembly of claim 1 wherein the peripheral recess has a depth of about 1–2 inches extending rearwardly from the entrance to a back of the recess.

11. The fenestration frame assembly of claim 1 wherein the leading edge of the mating projection is beveled.

12. The fenestration frame assembly of claim 1 wherein a body of the transverse member is thicker than the mating projection, defining an outwardly projecting shoulder at the junction of the body and the mating projection.

13. The fenestration frame assembly of claim 1 further comprising a support abutting an outer surface of the transverse member between the mating projection and the face.

14. A window frame assembly comprising:

a cover having a transverse member, which has opposed first and second edges, and a face carried adjacent the first edge, the transverse member including a mating projection along the second edge;

a main frame having a window opening and a confronting periphery, the confronting periphery including a peripheral recess and a guide, the peripheral recess being sized to telescopically receive a portion of the mating projection, the guide having an outwardly flared guide surface adapted to guide a leading edge of the mating projection into the recess; and a glazing pane sealingly supported in the window opening.

15. The window frame assembly of claim 14 wherein the guide comprises a cantilevered wall and the guide surface comprises an outwardly curved flare on a front portion of the wall.

16. The window frame assembly of claim 14 wherein the guide is adapted to bias the mating projection inwardly toward a confronting edge of the confronting periphery.

17. The window frame assembly of claim 14 wherein the peripheral recess has a depth of at least about 0.5 inches.

18. The window frame assembly of claim 14 wherein the peripheral recess has a depth of about 0.5–2 inches.

19. The window frame assembly of claim 14 wherein the peripheral recess has a depth of about 1–2 inches extending rearwardly from the entrance to a back of the recess.

20. The window frame assembly of claim 14 wherein the leading edge of the mating projection is beveled.

21. The window frame assembly of claim 14 wherein a body of the transverse member is thicker than the mating projection, defining an outwardly projecting shoulder at the junction of the body and the mating projection.

22. The window frame assembly of claim 14 further comprising a support abutting an outer surface of the transverse member between the mating projection and the face.

23. A window frame assembly comprising:

a cover having a transverse member, which has opposed first and second edges, and a face carried adjacent the first edge, the transverse member including a mating means along the second edge;

a main frame having a window opening and a confronting periphery, the confronting periphery including a peripheral recess and a guide means, the peripheral recess being sized to telescopically receive a portion of the mating means, the guide means having an outwardly flared guide surface adapted to guide a leading edge of the mating means into the recess; and a glazing pane sealingly supported in the window opening.

24. A retrofitted window comprising:

a building aperture having an inner surface;

an existing window frame component installed in the building aperture proximate the inner surface, the existing window frame component having an inner edge circumscribing an existing frame aperture smaller than the building aperture;

a cover comprising:

a transverse member having a first edge, a second edge spaced transversely from the first edge, an outer surface, and a mating projection along the second edge, the outer surface being juxtaposed with but spaced from the inner surface of the existing lining by a retrofit gap; and a face carried adjacent the first edge of the transverse member and extending peripherally outwardly from the transverse member a distance sufficient to span the retrofit gap;

a support received in the retrofit gap, the support engaging the inner surface of the building aperture and the outer surface of the transverse member;

a main frame at least partially received in the existing frame aperture, the main frame circumscribing a window opening and comprising:

an outer surface, at least a portion of which is supportively engaged by the inner edge of the existing window frame component; and a confronting periphery including a peripheral recess and a guide, a portion of the mating projection of the cover being telescopically received in the peripheral recess, the guide having an outwardly flared guide surface adapted to guide the mating projection into the entrance; and a glazing pane sealingly supported in the window opening.

25. The retrofitted window of claim 24 wherein the mating projection has a reduced thickness leading edge positioned within the peripheral recess inwardly of the guide surface.

26. A method of installing a window frame assembly, comprising:

positioning a main frame with respect to a window housing, the main frame having a window opening and a confronting periphery, the confronting periphery including a peripheral recess and a guide, the guide having an outwardly flared guide surface;

positioning a cover with respect to the window housing and the main frame, the cover including a mating projection along an edge; and inserting a reduced thickness leading edge of the mating projection into the peripheral recess, the guide engaging at least a portion of the mating projection leading edge and guiding the mating projection into the recess.

27. The method of claim 26 wherein the guide comprises a cantilevered wall and the guide surface comprises an outwardly curved flare on a front portion of the wall, the wall deflecting outwardly to increase a width of an entrance of the recess as the guide guides the mating projection into the recess.

28. The method of claim 26 wherein the window housing includes an existing window frame component that has an inner edge circumscribing an existing frame aperture, and wherein positioning the main frame with respect to the window housing comprises introducing a portion of the main frame into the existing frame aperture and supportively engaging an outer surface of the main frame with the inner edge of the existing window frame component.

29. The method of claim 26 wherein the window housing comprises an inner surface and an existing window frame component, the existing window frame component having an inner edge spaced inwardly from the inner surface and circumscribing an existing frame aperture, and wherein positioning the cover with respect to the window housing comprises:

juxtaposing an outer surface of a transverse member of the cover with the inner surface of the window housing; and supportively engaging a support with the outer surface of the transverse member and with the inner surface of the window housing.

* * * * *